United States Patent [19]

Siemon et al.

[11] Patent Number: 4,964,812

[45] Date of Patent: Oct. 23, 1990

[54] WIRE TERMINATION BLOCK

[75] Inventors: John A. Siemon, Woodbury; Brian Reed, New Hartford, both of Conn.

[73] Assignee: The Siemon Company, Watertown, Conn.

[21] Appl. No.: 439,634

[22] Filed: Nov. 21, 1989

[51] Int. Cl.[5] ..... H01R 4/24

[52] U.S. Cl. ..... 439/403

[58] Field of Search ..... 439/389–426

[56] References Cited

U.S. PATENT DOCUMENTS

| | | | |
|---|---|---|---|
| 3,496,522 | 2/1970 | Ellis, Jr. et al. | 439/403 |
| 3,611,264 | 10/1971 | Ellis, Jr. | 439/403 |
| 3,772,635 | 11/1973 | Frey et al. | 439/403 |
| 4,262,985 | 4/1981 | Muehlhausen II | 439/401 |

*Primary Examiner*—Joseph H. McGlynn

*Attorney, Agent, or Firm*—Fishman, Dionne & Cantor

[57] ABSTRACT

A wire connecting system which includes a pair of mating connectors for effecting electrical cross connections between a first set of of conductors and a second set of conductors is presented. The two mating connectors are known by the terms "wiring block" and "connecting block" wherein the wiring block provides evenly spaced receptacles for the first wire conductors that hold them in alignment for engagement with a plurality of insulation penetrating slotted beam contacts carried by the connecting block. The plurality of insulation penetrating slotted beam contacts housed by the connecting block are double ended such that, once the first set of wire conudctors are terminated, a second set of wire conductors are then indexed and retained by the connecting block for subsequent termination to the opposing ends of the insulation penetrating contacts by a tool or end cap designed for such a purpose. The connecting block employs a novel one piece structure which both forms the connector block housing as well as provides retention means for positioning and retaining the slotted beam contacts. These retention means comprise retention posts which are flash molded onto the side of the connecting block during the molding operation. Upon insertion and positioning of a plurality of beam contacts within the connecting block housing, pressure is exerted against the retention posts thereby breaking the flash molding and forcing the posts through positioning holes in the contacts. Thereafter, the post tips are peened in place providing permenant but free floating connection between the contacts and the connecting block housing. Still another important feature of the present invention is the novel use of a "zero gap" insulation displacement connector in the slotted beam contact.

14 Claims, 3 Drawing Sheets

WIRE TERMINATION BLOCK

BACKGROUND OF THE INVENTION

This invention relates generally to devices for making electrical cross-connections between two sets of conductors. More particularly, this invention relates to connecting devices for use in the communications industry comprising two basic components, namely a wiring block and a connecting block wherein the connecting block is a novel one-piece molded unit.

Wire connecting systems of the type described herein are well known and commercially available from AT&T Technologies as the 110 connector system. 110 type wiring systems are described in several prior patents including U.S. Pat. Nos. 3,611,264; 3,798,587 and 4,118,095.

Wire connecting blocks of the type disclosed in B. C. Ellis, Jr. U.S. Pat. No. 3,611,264, issued Oct. 5, 1971, include an indexing strip (wiring block) and a connecting block, the latter of which carries a plurality of slotted beam contacts. The indexing strip has a plurality of uniform height, spaced-apart teeth along its length. These teeth aid in indexing a first set of conductors. A corresponding plurality of uniform height, spaced-apart teeth carried by the connecting block serve to index a second set of conductors to be cross-connected through the slotted beam contact to the first set of conductors.

A number of improvements to the basic Ellis, Jr. connecting block are disclosed in B. C. Ellis, Jr. et al U.S. Pat. No. 3,798,587, issued Mar. 19, 1974. In the improved version, the spaced-apart teeth in both the indexing strip and the connecting block are staggered in height to facilitate indexing each set of conductors. The Ellis, Jr. et al connecting block is a two-piece structure comprised of matching halves which are secured together following insertion of the slotted beam contacts. However, it has been found that when the connecting block is placed over the indexing strip in cold temperatures, certain stresses are applied to the bond between the two connector parts. These stresses often rupture the bond causing failure of the entire unit.

The problems associated with U.S. Pat. No. 3,798,587 were improved upon in U.S. Pat. No. 4,118,095 issued Oct. 3, 1978 to Berglund et al. As in U.S. Pat. Nos. 3,611,264 and 3,798,587, Berglund et al relates to a wire connecting block which includes a pair of mating connectors (e.g., connecting block and wiring block) for effecting electrical cross-connections between a first set of conductors and a second set of conductors. The first connector indexes the first conductors and holds them in alignment for engagement with a plurality of insulation-penetrating slotted beam contacts carried by the second connector.

Rather than the connecting block comprising two substantially matching halves as in U.S. Pat. No. 3,798,587, in the Berglund et al patent, the connecting block comprises a housing which mates with a discrete anchoring member. The separate anchoring member is a molded piece which acts to position and retain the plurality of spaced beam contacts.

While the use of the housing/anchoring member presents an improvement to the structure of U.S. Pat. No. 3,798,587, the Berglund et al structure nevertheless suffers from certain deficiencies and drawbacks. For example, the connecting block of Berglund et al is still comprised of two discrete molded parts (e.g. the housing member and the anchoring member). The use of the second molded part (e.g., anchoring member) to hold in contacts increases assembly time, inventory, tooling cost and, consequently, the overall cost of the part to the end user. In addition, the second molded part (e.g. anchoring member) may be removed (for example, due to a faulty ultrasonic weld) thereby destroying the connector assembly.

Another detrimental characteristic of prior art connecting blocks described in U.S. Pat. Nos. 3,611,264; 3,798,387 and 4,118,095 results from the requirement that they be continuously end stackable on the wiring block. Because the existing embodiments of prior art designs preserve the contact center spacing to maintain precise alignment with the mating receptacles on the wiring block, the resulting insulating barrier that confines the outside surfaces of the end contacts is thin, and therefore prone to breakage when required to terminate the large wire gauges (e.g., 22 AWG wire) presently in use for data transmission applications. When such breakage occurs on the ends of adjacent connecting block modules, electrical shorting results.

Still another drawback to the Berglund et al connector (as well as the connectors of U.S. Pat. Nos. 3,611,264 and 3,798,587) is the use of a conventional "gapped" insulation displacement contact (IDC) which forms a portion of the bifurcated beam contact.

The most common method of manufacturing insulation displacement type contacts involves a progression of steps which include a gutting operation to produce an elongated cutout followed by a shearing operation which results in a closed gap IDC slot extending from the cutout to the upper edge of the Part. In this state, the preload on the contact beam elements is at or close to zero and may therefore lack sufficient means to inhibit the contamination of the contact surface due to prolonged exposure to airborne moisture and other corrosive elements. A common way to circumvent the problem of contamination of the contact surface is plating. However, to achieve adequate plating thickness in the sheared area required for electrical contact, a gap is provided to insure adequate circulation of plating solution in the IDC slot. This gap is commonly produced by a coining operation just below the wire termination area on the IDC slot. This approach is successful and in wide use among many IDC contact designs including those of the previously listed patents along with those disclosed in U.S. Pat. Nos. 4,295,703; 4,468,079 and 4,140,867.

However, the "gapped" IDC also suffers from certain drawbacks. As mentioned above, the gap between the contact tynes (or beams) is formed during manufacturing, by a coining process at the bottom of the IDC to allow for uniform plating in the region of electrical contact. The effect of this coin is threefold. First, the gap limits the range of wire gages that can be terminated by this contact. Wires with a diameter less than or equal to the width of the gap, will not make contact with adequate force to maintain the required gas tight connection. The IDC is limited to wire gages larger than the IDC slot so that the normal force exerted on the wire is sufficient to accomplish a gas tight electrical connection. Secondly, the gapped IDC limits the use of the contact to solid wire only. When stranded wire is terminated, the wires will tend to separate and line up in the slot upon initial termination or over time. This movement may allow the gapped IDC to close to the preterminated state resulting in intermittent or open connections. Lastly, the gapped IDC, in its unterminated state, has increased exposure to the corrosive effects of air-borne contaminants which mandate the use of a protective coating or plating for most materials. In contrast, the contact surfaces of an IDC slot that is forced closed by sufficient preload is much less susceptable to surface contamination due to its decreased exposure to the elements required to sustain the reactions which result in corrosion or the like.

SUMMARY OF THE INVENTION

The above discussed and other problems and deficiencies of the prior art are overcome or alleviated by the electrical connecting system of the present invention. In accordance with the present invention, a wire connecting system which includes a pair of mating connectors for effecting electrical cross connections between a first set of conductors and a second set of conductors is presented. The two mating connectors are known by the terms "wiring block" and "connecting block" wherein the wiring block provides evenly spaced receptacles for the first wire conductors that hold them in alignment for engagement with a plurality of insulation penetrating slotted beam contacts carried by the connecting block. The plurality of insulation penetrating slotted beam contacts housed by the connecting block are double ended such that, once the first set of wire conductors are terminated, a second set of wire conductors are then indexed and retained by the connecting block for subsequent termination to the opposing ends of the insulation penetrating contacts by a tool or end cap designed for such a purpose. It will be appreciated that the wiring block is a well known means for aligning and supporting wire conductors and does not include any metal beam contacts.

In accordance with an important feature of the present invention, the connecting block employs a novel one piece structure which both forms the connector block housing as well as provides retention means for positioning and retaining the slotted beam contacts. These retention means comprise retention Posts which are flash molded onto the side of the connecting block during the molding operation. Upon insertion and Positioning of a plurality of beam contacts within the connecting block housing, pressure is exerted against the retention posts thereby breaking the flash molding and forcing the posts through positioning holes in the contacts. Thereafter, the post tips are peened in place providing permanent but free floating connection between the contacts and the connecting block housing.

The use of the one-piece housing of the present invention thereby overcomes the several deficiencies and disadvantages relative to the two-piece connecting block structures associated with the prior art. The present invention thus decreases assembly time, inventory and tooling costs leading to an overall lower cost for the connecting block portion of the electrical wiring system.

The present invention overcomes the problem of inadequate end wall strength discussed above by making use of the free floating contact retention inherent to both the present invention and prior art designs. This is accomplished by employing irregular contact spacing on the end positions of the connecting block module. As a result, the tendency for outside wall breakage is substantially reduced. Reduction in center spacing for the two end contact problems (typically by about "0.005" per side) allows for an increase in outside wall thickness by approximately 30% while also acting to inwardly bias the upper halves of the outside contact when mated with the wiring block. The free floating nature of the terminal clips easily allows for the non-cumulative spacing deviation between the outer two positions of the connecting block and wiring block without compromising connection integrity or compatibility with accessories common to both the present invention and prior art designs.

Still another important feature of the present invention is the novel use of a "zero gap" insulation displacement connector in the slotted beam contact. In contrast to the coined gap found in conventional IDC beam contacts, the "zero gap" IDC used in the present invention is formed by shearing the two tynes of the contact and relocating the coining operation such that the closed IDC gap is maintained with an established preload that keeps the bare IDC surface clean and free of contamination prior to wire termination. This "zero gap" contact configuration allows smaller wiring diameters to be terminated successfully while still maintaining a good normal force. The "zero gap" structure also allows for a successful termination of a wide range of stranded wire and alleviates the need for costly secondary plating operations.

The above discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 2:
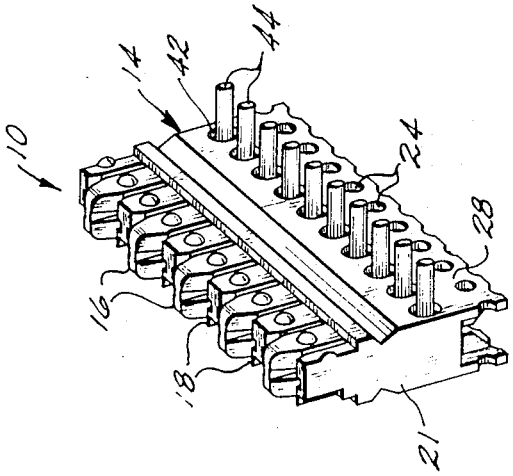
FIG. 2 is a perspective view of the connecting block housing of the present invention prior to assembly.

The present invention relates to a wire connecting system which includes a pair of mating connectors for effecting electrical cross connections between a first set of conductors and a second set of conductors. The first connector known as the "wiring block" indexes the first conductors and holds them in alignment with a plurality of insulation penetrating beam contacts carried by the second connector which is known as the "connecting block". The electrical wiring system of the present invention is similar to the wiring system described in FIG. 2 of U.S. Pat. No. 3,798,587 (the entire contents of which is incorporated herein by reference) wherein the wiring block is shown at item 33 affixed to a support carrier 37 and a connecting block 34 is positioned for attachment to the wiring block. As the present invention is directed to improvements in the connecting block per se, then for the sake of simplicity, the features of the wiring block and support carrier are not fully disclosed in the drawings and description herein. Accordingly, reference should be made to U.S. Pat. No. 3,798,587 for a detailed description of these latter components.

Figure 1:
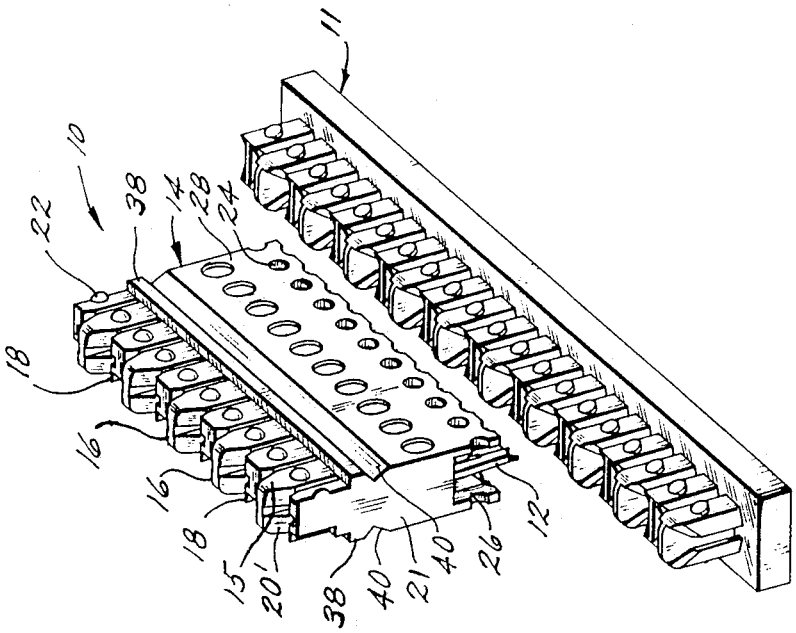
FIG. 1 is perspective view of a connecting block in accordance with the present invention loaded with a plurality of IDC contacts and in position for engagement with a wiring block representative of the prior art.

Referring now to FIGS. 1–5, a connecting block in accordance with the present invention is shown generally at 10. It will be appreciated that FIG. 1 depicts connecting block 10 with a plurality of beam contacts 12 and positioned for engagement with a wiring block 11, while said beam contacts 12 are not shown in FIGS. 2–5. Connecting block 10 comprises a one piece molded housing 14 shown in FIG. 2 made from a suitable insulative material (preferably polycarbonate). Housing 14 is substantially rectangular in shape and includes a plurality of spaced apart teeth 16 and 18 along the length of its upper surface. Teeth 16 and 18 alternate or stagger in height to facilitate indexing of a second set of conductors (not shown) in wire strain relief slots 15. Also, as is conventional with connecting blocks of this type, teeth 16,18 include tapered sides to facilitate entry of wire conductors. As is well known with connecting blocks of this type, a cover, wiring adapter or Patch connector may be positioned along the teeth 16,18 and engaged such that the connecting block is detachably interlocked in a manner that is similar to the attachment means between connecting block 10 and wiring block 11. To permit this stacking with a mechanical detent, a plurality of semispherical protrusions 22 are provided on the front and rear surfaces of the spaced apart staggered teeth 16,18 for resilient interlocking with corresponding openings 24 from a mating device.

Figure 3B:
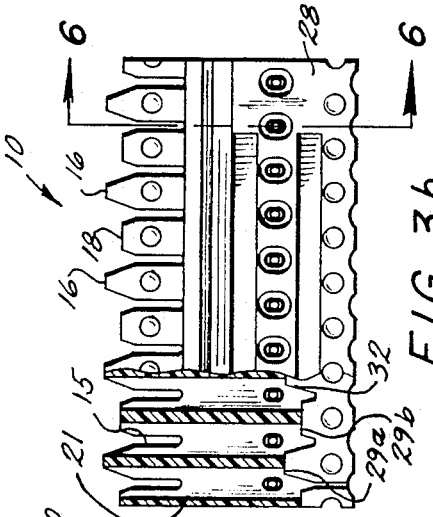
FIG. 3*b* is a partially cutaway rear elevation view of the housing of FIG. 2.
Figure 4:
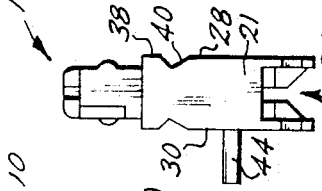
FIG. 4 is a side elevation view of the housing of FIG. 2.
Figure 3A:
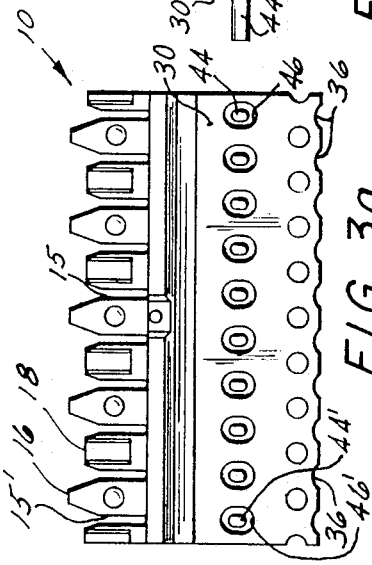
FIG. 3*a* is a front elevation view of the connecting block housing in accordance with the present invention.

In addition, as shown by FIG. 3*a*, mating connectors that are polarity sensitive may be designed with rib projections contoured to fit into channel slots 17 provided on the front surface of only teeth 16. Channel slots 17 thereby provide means for blocking the engagement of mating connectors that are not properly oriented with respect to polarity.

The lower portion of housing 14 includes a U-shaped cavity 26 formed by two depending sides 28 and 30 of housing 14. Within cavity 26 and spaced between the upper and lower surfaces of housing 14 is a planar molded floor 29 (see FIGS. 3*b* and 5) having a plurality of rectangular openings 31 therethrough. Openings 31 are sized to receive and position individual beam contacts such as the beam contacts shown at 12 in FIGS. 9 and 10. Spaced openings 31 continue though the upper portion of housing 14 through staggered teeth 16, 18 to form opposed channels 20 for receiving and guiding beam contacts during assembly. It should be noted that, while mechanical interlock features 17, 22 and others are maintained at a constant and precise center spacing, the two end positions defined by strain relief slot 15', channels 20', space 31' and corresponding contact retention features are at a center spacing that is less than the typical spacing defined by other contact positions and the receiving wiring block features. This spacing condition provides increased mechanical integrity of end walls 21 and decreases the stress on said end walls by introducing an inwardly oriented bias offset of the upper beam elements of contact 12 when mated with wiring connector 11. This spacing configuration is an important structural feature of the present invention.

Figure 5:
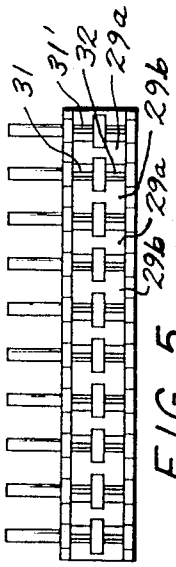
FIG. 5 is a bottom view of the housing of FIG. 2.

Floor 29 is staggered relative to the staggered teeth 16,18 such that a floor portion 29A positioned beneath a tooth 16 is spaced farther away from the lower portion of housing 14 relative to a floor portion 29B spaced beneath tooth 18. Between each floor portion 29A and 29B is a divider wall 32 which (as shown in FIGS. 3*b* and 5) is interrupted by space 31. The lower edges of sides 28 and 30 of housing 14 have a scalloped configuration comprised of spaced radii 36. Between each radius 36 is the aforementioned opening 24 for engaging ramped cylindrical protrusions from the wiring block 11 shown in FIG. 1 for fixedly attaching connecting block 10.

Below staggered teeth 16,18 and along each side surface 28 and 30 is a ridge 38 followed by a V-shaped indentation 40. One of the ridges 38 (shown in FIG. 3A) is interrupted by a depression 42. Depression 42 includes a small rounded bump 44 therein which is recessed below surface 38 and which serves as a gate area for injection molding.

In accordance with another important feature of the present invention, the one piece molded housing 14 includes a plurality of laterally extending contact retention posts 44. Each post 44 is surrounded by a partial aperture 46 formed in side surface 30 of housing 14. Significantly, each post 44 is flash molded within each partial opening 46. In other words, each post 44 is integral to side surface 30 of housing 14 at a mating edge which is comprised of a very thin (e.g. less than 0.015) layer of molding (plastic) material. It will however be appreciated that the entire housing 14, including posts 44, are all formed in a single molding operation. Opposed side surface 28 includes a plurality of spaced apertures 48 which pass completely through side wall 28 of housing 14 and which are mutually aligned with respective partial openings 46 and 47 in side surface 30 as shown in FIG. 6A.

Figure 9:
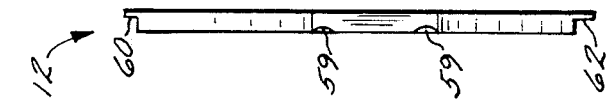
FIG. 9 is a side elevation view of the beam contact for use in the present invention.
Figure 10:
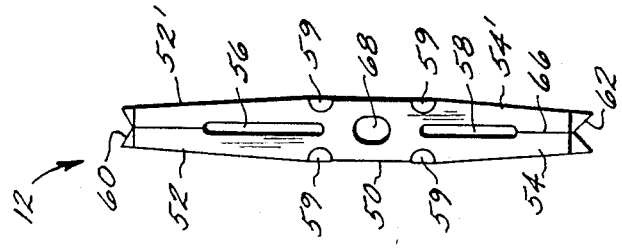
FIG. 10 is a front elevation view of the beam contact of FIG. 9.

As shown in FIGS. 9 and 10, wire connecting block 10 of the present invention incorporates a plurality of spaced beam contacts 12. Each contact 12 includes a central portion 50 which has first and second pairs of oppositely directed cantilever beams 52, 52' and 54, 54' extending therefrom. Each of the pairs of beams 52, 52' and 54, 54' are spaced apart from one another by elongated generally rectangular openings 56 and 58, respectively. Openings 56 and 58 extend from central portion 50 to a point near a pair of oppositely directed insulating, penetrating edges 60 and 62, respectively at the end of beams 52, 52' and 54, 54'. It will be appreciated that beams 54, 54' are of shorter length than beams 52, 52' to increase the force provided by edges 62 during engagement with conductor insulation and to increase the resiliency of contact beam portions not totally enshrouded in plastic. As will be discussed in more detail hereinafter, each beam 52, 52' and 54, 54' is comprised of a pair of tynes which is formed by shearing each beam at shear line 64 and 66 between openings 56,58 and edges 60, 62, respectively. The shearing action will thus provide an insulation displacement connector having a "closed gap" between the tynes of each beam. Subsequently, the closed gap is transformed to a "zero gap" by coining the outside edges at the base of each beam element. Decreased coin surfaces, as shown in FIGS. 9 and 10, (penetrating approximately 10% of the material thickness) serve to (1) preload beam elements 52, 52', 54; (2) maintain clean contact surfaces prior to termination and (3) raise contact normal force on small diameter conductors to an acceptable level for assuring high reliability. Also included in central portion 50 is a generally oval shaped aperture 68 which is used in mounting contact 12 in connector block housing 14 to form connector block 10.

The limitations of this open gap IDC clip design and fabrication technique in terms of wire size and plating as discussed above are well known and are overcome by the present invention which, rather than placing a single coin at the base of the IDC to facilitate plating of the sheared contact surfaces, eliminates the need for a secondary plating operation by coining the base of each beam element in such a way as to force the IDC slot into a preload condition with zero gap. This coining technique is beneficial in several distinct respects. First, it produces a gas tight interface between the beam surfaces (that define the IDC slot) which inhibits corrosion in the unterminated state without secondary plating. Second, the preload allows the contact to function with smaller diameter wires than allowed by the slot coining method because the gap (up to 0.008") is eliminated and because, for a given beam cross section and deflection, the pre-loaded zero gap configuration will exert insulation removal and contact normal force on the terminated wire. Therefore, by eliminating the need for secondary plating operations (i.e., preplated materials may be used), and by allowing for sufficiently high contact force to maintain good electrical connections throughout an IDC gap range of 0 to the elastic limit of the material, the present invention allows for the minimization of production costs while providing increased versatility in terms of the types and gauges of compatible terminating conductors.

Figure 7:
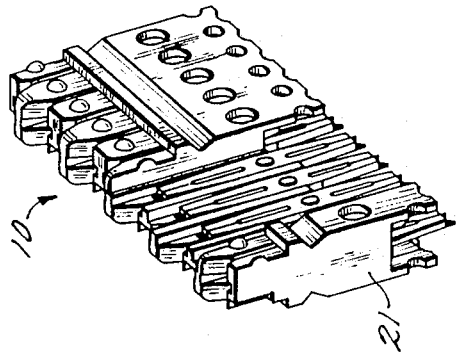
FIG. 7 is a perspective view, similar to FIG. 1, with portions cut away showing beam contact orientation.
Figure 8:
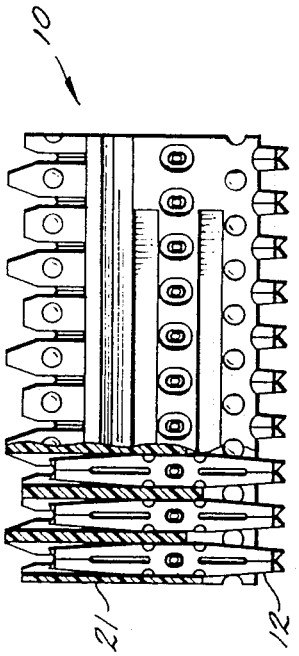
FIG. 8 is a front elevation view similar to FIG. 7.
Figure 6D:
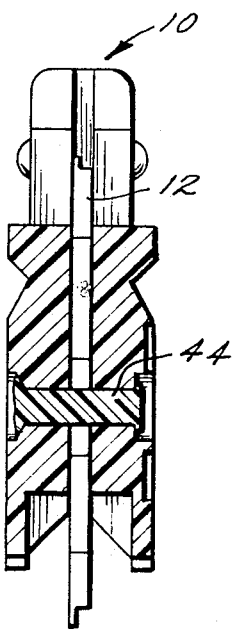
FIGS. 6A–6D are sequential views along the line 6—6 of FIG. 36 with contact added depicting the connecting block housing 1 being fully assembled.
Figure 6C:
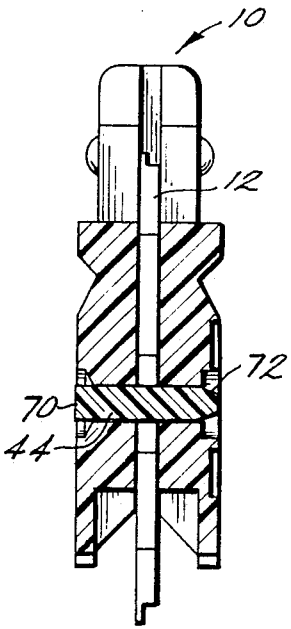
Figure 6B:
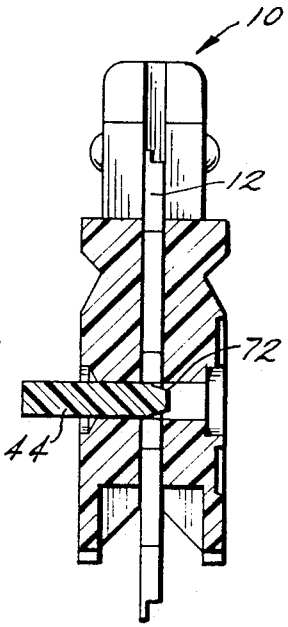
Figure 6A:
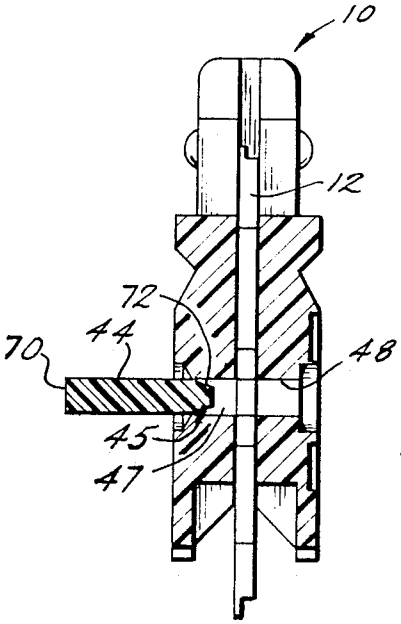

Turning now to FIGS. 6A–6D, the method of assembling connector block 10 of the present invention will now be discussed. Prior to assembly, the housing 14 is mounted in a suitable fixture and a plurality of beam contacts 12 are loaded into housing 14 such that apertures 68 in contacts 12 will be in alignment with posts 44 and apertures 48 in housing 14. This initial positioning is depicted in FIG. 6A. Next, and as shown in FIG. 6B, posts 44 are simultaneously forced downwardly with sufficient force so as to break the flash molding 45 (which had maintained posts 44 in their laterally outwardly extending position, shown in FIGS. 2–6A) and force pins 44 through partial opening 47 and oversized contact aperture 68. Next, each pin is further driven through housing 14 and aperture 68 of contact 12 and through aperture 48 until the flattened end 70 of pin 68 is approximately flush with the side surface 30 of housing 14. The nose portion of post 44 is provided with a tapered surface 72 so as to facilitate passage of post 44 through oversized aperture 68 of contacts 12 and aperture 48 of side wall 28. Next, as shown in FIG. 6D, the ends 70 an 72 of posts 44 are peened in place preferably by heat staking so as to permanently retain said posts in place in position in housing 14 and thereby permanently retain and align the plurality of contacts 12 in position. The finally assembled connecting block 10 is shown in perspective in FIG. 1, 7 and 8.

The connecting block of the present invention provides several important features and advantages relative to the two piece connecting blocks of the prior art. For example, the housing of the present invention requires only a single part which both provides a housing for the beam contacts as well as providing a means of permanently retaining the beam contacts within the housing. This in distinct contrast to the prior art two piece housings wherein the second anchoring piece could be removed thereby destroying the connector assembly. It will be appreciated the use of a one piece molded housing will decrease assembly time, inventory and tooling costs relative to the two piece molded housings of the prior art. Accordingly, the present invention provides an overall cost savings to the end user.

The present invention overcomes the problem of inadequate end wall strength discussed above by making use of the free floating contact retention inherent to both the present invention and prior art designs. As already stated, this is accomplished by employing irregular contact spacing on the end positions of the connecting block module. As a result, the tendency for outside wall breakage is substantially reduced. Reduction in center spacing for the two end contact problems (typically by about 0.005" per side) allows for an increase in outside wall thickness by approximately 30% while also acting inwardly to bias the upper halves of the outside contact when mated with the wiring block. The free floating nature of the terminal clips easily allows for the non-cumulative spacing deviation between the outer two positions of the connecting block and wiring block without compromising connection integrity or compatibility with accessories common to both the present invention and prior art designs.

As mentioned, each beam contact 12 is formed by shearing the two tynes of the contact and relocating the coining operation associated with prior art beam contacts. This results in a "zero gap" insulation displacement or IDC connector. This zero gap contact configuration allows smaller wire diameters to be terminated successfully while still maintaining a good normal force. It will be appreciated that the contact 12 of the present invention will not include a fixed gap as in the prior art. This results in an increase of the range of acceptable wire gages for termination permitted by the present invention. The zero gap configuration of the present invention also allows for successful termination of a wide range of stranded wire. Stranded wire (even small gages) can thus be utilized with the present invention with much less sensitivity to the rigors of harsh environments or the problems created in conventional IDC's when the strands string themselves out rather than remaining tightly wrapped. Since the "gap" on the contact 12 of the present invention is closed with sufficient preload to maintain adequate contact forces on very small diameter conductors when the wires separate and line up, sufficient normal force is still exerted on the strands to maintain a gas tight connection. Still another feature of the contact 12 of the present invention is that since the cuts 64,66 are formed by a shearing action and therefore has clean, fresh metal against clean, fresh metal right up until the moment of termination, then there can be no gap (as in the prior art) between the tynes of the contact for corrosion to form and therefore the need for secondary plating operations is eliminated.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A connecting block for housing a plurality of insulation penetrating beam contacts, comprising:

a housing having first and second spaced apart sidewalls and opposed upper and lower ends;

a plurality of spaced apart insulation penetrating beam contacts in said housing extending between said upper and lower ends, each of said contacts having a first aperture therethrough;

a plurality of spaced openings through said second sidewalls of said housing, one each of said openings being aligned with one each of said apertures in said beam contacts; and a plurality of spaced contact retention posts integrally molded to said first sidewall of said housing and extending laterally from said first sidewall, one each of said posts being mutually aligned with one each of said openings and one each of said apertures wherein said posts are forced under pressure to break away from said first sidewalls and are positioned through said apertures and openings to thereby retain said beam contacts within said housing.

2. The connecting block of claim 1 including:

a partial opening surrounding each of said posts in said first sidewall, each of said posts being molded within a corresponding partial opening by a thin layer of molding material.

3. The connecting block of claim 2 wherein each of said posts have opposed first and second ends, said second end being molded within said partial opening, and wherein:

said second end is tapered.

4. The connecting block of claim 1 wherein each of said posts have opposed ends, said opposed ends being heat peened to permanently retain said posts in said housing.

5. The connecting block of claim 1 wherein each of said beam contacts comprise:

a pair of opposed beams extending from opposed ends of said aperture, each of said beams being sheared to define a pair of tynes, said sheared tynes normally remaining in contact until a conductor is inserted between said sheared tynes.

6. The connecting block of claim 5 wherein:

each of said pairs of sheared tynes are pre-loaded to maintain mutual contact.

7. The connecting block of claim 1 wherein said upper end of said housing comprises:

spaced-apart teeth defining wire conductor retaining slots for capturing and holding wire conductors.

8. The connecting block of claim 7 wherein:

said teeth have staggered heights.

9. The connecting block of claim 1 including:

a plurality of spacing means in said housing for spacing and aligning said contacts, said spacing means including a pair of opposed end spacing means and a plurality of interior spacing means between said end spacing means, said interior spacing means spacing said contacts at a first center distance and said end spacing means spacing said contacts a second center distance, said second center distance being less than said first center distance.

10. A connecting block for housing a plurality of insulation penetrating beam contacts, comprising:

a housing having first and second spaced apart sidewalls and opposed upper and lower ends;

a plurality of spaced apart insulation penetrating beam contacts in said housing extending between said upper and lower ends; and a plurality of spacing means in said housing for spacing and aligning said contacts, said spacing means including a pair of opposed end spacing means and a plurality of interior spacing means between said end spacing means, said interior spacing means spacing said contacts at a first center distance and said end spacing means spacing said contacts a second center distance, said second center distance being less than said first center distance.

11. A connecting block for housing a plurality of insulation penetrating beam contacts, comprising:

a housing having first and second spaced apart sidewalls and opposed upper and lower ends;

a plurality of spaced apart insulation penetrating beam contacts in said housing extending between said upper and lower ends, each of said contacts having a first aperture therethrough wherein each of said beam contacts comprise a pair of opposed beams extending from opposed ends of said aperture, each of said beams being sheared to define a pair of tynes, said sheared tynes normally remaining in contact until a conductor is inserted between said sheared tynes, each of said pairs of sheared tynes being pre-loaded to maintain mutual contact.

12. The connecting block of claim 11 wherein each of said pair of beams has a base and wherein:

said preload is provided by coining outside edges of said base of each of said pair of beams.

13. A beam contact comprising:

a pair of opposed beams extending from opposed ends of an aperture, each of said beams being sheared to define a pair of tynes, said sheared tynes normally remaining in contact until a conductor is inserted between said sheared tynes, each of said sheared tynes being pre-loaded to maintain mutual contact.

14. The beam contact of claim 13 wherein each of said pair of beams has a base and wherein:

said preload is provided by coining outside edges of said base of each of said pair of beams.

* * * * *